US010883330B2

(12) United States Patent
Ellison

(10) Patent No.: US 10,883,330 B2
(45) Date of Patent: Jan. 5, 2021

(54) ANNULAR BLOW OUT PREVENTER

(71) Applicant: Enovate Systems Limited, Aberdeen (GB)

(72) Inventor: Stuart Ellison, Aberdeen (GB)

(73) Assignee: ENOVATE SYSTEMS LIMITED, Aberdeen (GB)

( * ) Notice: Subject to any disclaimer, the term of this patent is extended or adjusted under 35 U.S.C. 154(b) by 244 days.

(21) Appl. No.: 14/914,821

(22) PCT Filed: Aug. 27, 2014

(86) PCT No.: PCT/GB2014/052593
§ 371 (c)(1),
(2) Date: Feb. 26, 2016

(87) PCT Pub. No.: WO2015/028790
PCT Pub. Date: Mar. 5, 2015

(65) Prior Publication Data
US 2016/0222749 A1 Aug. 4, 2016

(30) Foreign Application Priority Data
Aug. 27, 2013 (GB) ..... 1315216

(51) Int. Cl.
*E21B 33/06* (2006.01)
*E21B 33/12* (2006.01)

(52) U.S. Cl.
CPC ..... *E21B 33/06* (2013.01); *E21B 33/1208* (2013.01)

(58) Field of Classification Search
CPC .... E21B 33/061; E21B 33/062; E21B 33/064; E21B 33/085; E21B 33/08; E21B 33/126; E21B 2033/005; E21B 33/1212; E21B 33/1208; E21B 29/08; F16K 3/03
USPC ..... 251/1.1–1.3; 166/85.4, 84.3, 177.3; 277/343, 339, 344, 632, 627, 626, 644, 277/650, 647, 327
See application file for complete search history.

(56) References Cited

U.S. PATENT DOCUMENTS 3,323,773 A * 6/1967 Walker ..... E21B 33/06 251/1.2
3,591,125 A * 7/1971 Lewis ..... E21B 33/06 251/1.2
3,917,293 A * 11/1975 Lewis ..... E21B 33/06 251/1.2
4,095,805 A * 6/1978 Allen ..... E21B 33/06 251/1.1

(Continued)

OTHER PUBLICATIONS

International Search Report corresponding Int'l Pat. Appl. No. PCT/GB2014/052593, dated Apr. 15, 2015, 2 pages.

*Primary Examiner* — Umashankar Venkatesan
*Assistant Examiner* — Andrew J Rost
(74) *Attorney, Agent, or Firm* — Tarolli, Sundheim, Covell & Tummino LLP

(57) ABSTRACT

An annular packer (10) for use with an annular blow out preventer (20) formed of a plurality of blades or elements (21,30,72) where each of the blades (21,30,72) is curved and arranged in the annular bore such that the curve of the blade is not parallel with the longitudinal axis of the assembly. This creates an "iris" type of geometry which, as the iris closes, the annular bore (24) transforms from a parallel cylindrical shape to a smaller bore with a shape having at least one waist or pinch point (32,34,73,75) of smaller cross-section.

15 Claims, 8 Drawing Sheets

(56) References Cited

U.S. PATENT DOCUMENTS

| | | | | |
|---|---|---|---|---|
| 4,098,341 | A * | 7/1978 | Lewis | E21B 33/06 166/387 |
| 4,098,516 | A | 7/1978 | Murman | |
| 4,508,311 | A | 4/1985 | Just et al. | |
| 4,657,263 | A * | 4/1987 | Hynes | E21B 33/06 251/1.3 |
| 8,176,933 | B2 * | 5/2012 | Huff | B29C 35/0222 137/315.02 |
| 9,388,657 | B2 * | 7/2016 | Nelson | E21B 33/06 |
| 2004/0164494 | A1 | 8/2004 | Araujo | |

* cited by examiner

ANNULAR BLOW OUT PREVENTER

RELATED APPLICATIONS

The present application is a U.S. National Stage under 35 USC 371 patent application, claiming priority to Serial No. PCT/GB2014/052593, filed on Aug. 27, 2014, which claims priority from GB 1315216.0, filed on Aug. 27, 2013, both of which are incorporated herein by reference.

FIELD OF INVENTION

The present invention relates to an improved annular blow out preventer and to an annular packer for use therewith.

Annular blow out preventers are in common use in the oil industry, they are devices designed to control the flow or displacement through the well bore section. Annular blow out preventers require a variable means of restricting and/or closing the open section through which the material can move.

BACKGROUND OF THE INVENTION

U.S. Pat. No. 4,508,311 discloses an annular blow out preventer with an annular packer in the chamber which consists of a plurality of flat plates which when actuated can be moved together to provide a smaller annulus bore. When the elements are actuated to a closed position the through bore is reduced but parallel. This arrangement does not provide a leading entry for pipe stripping or a hang-off zone.

It is an object of the present invention to provide an improved annular blow out preventer which obviates or mitigates at least one of the aforementioned disadvantages.

This is achieved by providing an annular packer for use with an annular blow out preventer formed of a plurality of blades or elements where each of the blades is curved and arranged in the annular bore such that the curve of the blade is not parallel with the longitudinal axis of the assembly. This creates an "iris" type of geometry which, as the iris closes, the annular bore transforms from a parallel cylindrical shape to a smaller bore with a shape having at least one waist or pinch point of smaller cross-section.

The principal advantages of this arrangement are that the hourglass shape of the bore provides improved performance for stripping pipes through the seal due to the natural lead provided by the bore by the funnel shape arrangement at the top of the hourglass and, when closed, the waist of the hourglass forms a hard stop which results in a complete circular keystone arrangement directly below a tool hang off zone for suspending loads. In addition the funnel shape provided at the top of the hourglass acts to blur the contact edge of any applied force and thus minimize the generation of share loads in a work piece. This also improves stripping of pipe whilst the upward facing funnel also provides a natural feature for which strings can be readily suspended in the well bore.

SUMMARY OF THE INVENTION

In accordance with a first aspect of the invention there is provided a packer for an annular blow out preventer (BOP) which has a BOP housing defining a through bore, said annular packer being disposed in said housing, said annular packer having a plurality of circumferentially spaced movable elements, each of said elements being substantially identical and moveable radially between a first position where the diameter of the through bore is a maximum and a second position where the diameter is a minimum, piston means disposed in said housing and actuatable for moving said elements from said first to said second position, each element being curved relative to a plane parallel to a longitudinal axis of the annular BOP and each element being dimensioned and proportioned to fit together with adjacent elements, each element having a curved leading edge, whereby, in use, actuation of said piston engages each of said elements and moves said elements to the second position, whereby the curved leading edges of said elements form a smaller bore with a narrower cross-section than in the first position.

Preferably each element is formed by a single curve.

Alternatively each element has a plurality of curves and corresponding curved leading edges whereby when said piston means is actuated the elements are displaced to provide a corresponding plurality of narrower cross-sections axially separated along said through bore.

Preferably the elements are dimensioned and proportioned so that in said second position the smaller through bore is symmetrical about the narrower cross-section.

Alternatively the elements are dimensioned and proportioned so that in said second position the smaller through bore is asymmetrical about the narrower cross-section.

Preferably the packer has thirty-six identical elements.

Alternatively the packer has a number of identical elements sufficient to form a tapered bore to provide stripping of pipe and for suspending tools.

Conveniently said elements are coated in resilient elastomer such that when pressure on said piston is released when said elements are in second position, the resilience of said elastomer moves said elements back to the first position.

Conveniently each of the elements is metal.

Conveniently also a portion of the leading edge of each of said blades is stepped so that in said second position an upper funnel portion is defined for facilitating pipe stripping and tool string suspension.

In accordance with a second aspect of the invention there is provided an annular packer with a plurality of curved elements disposed around the circumference of the packer, said curved elements being shaped so that when said packer is actuated to a closed position, the interior of the packer defines a throughbore with at least one waist or pinch section of minimum diameter.

In accordance with a third aspect of the invention there is provided an annular blow out preventer (BOP) having a BOP housing defining a throughbore and an annular packer in accordance with the first or second aspects of the invention.

In accordance with a fourth aspect of the invention there is provided a method for sealing a packer comprising:

providing an annular packer in a housing of an annular blow out preventer (BOP), the BOP housing defining a through bore, said annular packer having a plurality of circumferentially spaced movable elements, each of said elements being substantially identical and moveable radially between a first position where the diameter of the through bore is a maximum and a second position where the diameter is a minimum, each element being curved relative to a plane parallel to a longitudinal axis of the annular BOP and each element being dimensioned and proportioned to fit together with adjacent elements, each element having a curved leading edge, and actuating piston means disposed in said housing to engage and move said elements from said first position to said second position, whereby the curved leading edges of said elements form a smaller bore with a narrower cross-section.

The features described in connection with any aspect of the invention may equally apply to any other aspect, and are not repeated here merely for reasons of brevity.

BRIEF DESCRIPTION OF THE DRAWINGS

These and other aspects of the invention will become apparent from the following description when taken in combination with the accompanying drawings in which:

FIG. 3(*b*) is a sectional view taken on lines 3(*b*)-3(*b*) of FIG. 3(*a*) and shows an enlarged view of the annular packer;

FIG. 3(*c*) is a view similar to FIG. 3(*a*) but with the annular packer actuated to a closed position;

FIG. 3(*d*) is a cross-sectional view taken in the lines 3(*d*) similar to FIG. 3(*b*) and showing the annular packer actuated to the closed position;

FIG. 9(*b*) is a cross-sectional view taken on the lines 9*b*-9*b* of FIG. 9;

FIG. 10(*b*) is a similar view to FIG. 10(*a*) but with the piston actuated to move the annular packer to the closed position such that the packer is shown engaging the outer surface of the drill string;

DETAILED DESCRIPTION OF THE INVENTION

Figure 1A:
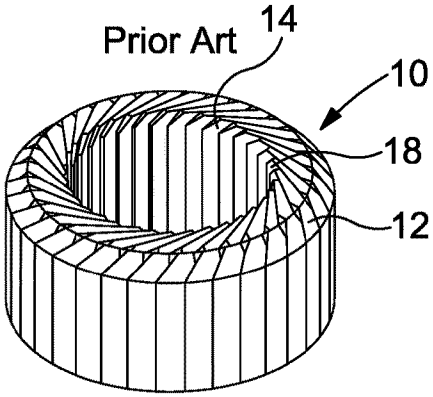
FIGS. 1(*a*), (*b*) and (*c*) depict a prior art annular packer.
Figure 1B:
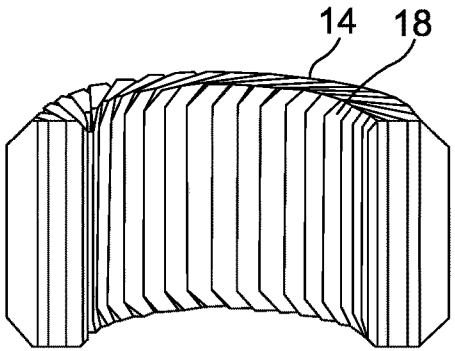
Figure 1C:
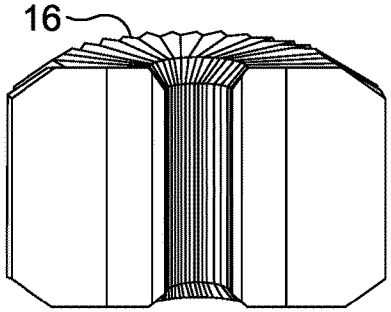
Figure 3A:
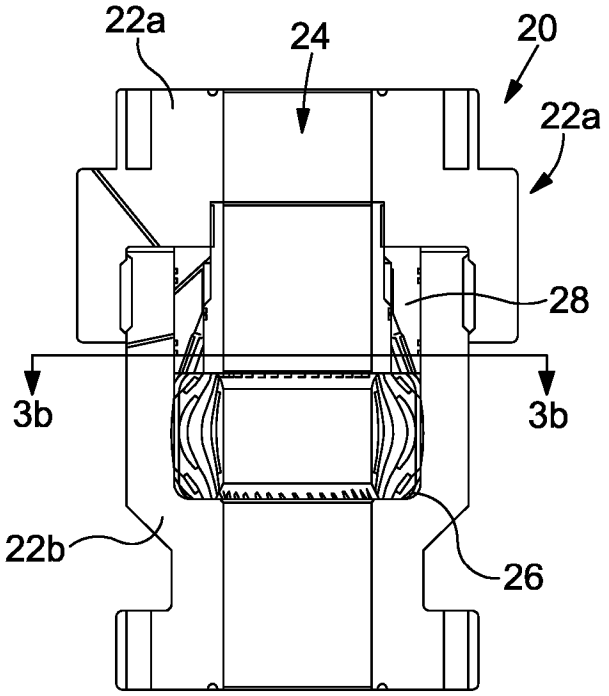
FIG. 3 is a longitudinal sectional view through an annular BOP in accordance with an embodiment of the present invention with an annular packer shown in the open position.
Figure 3B:
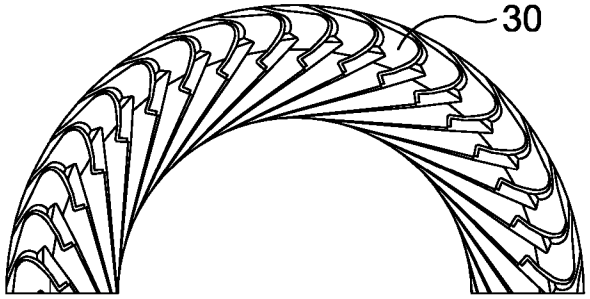
Figure 3C:
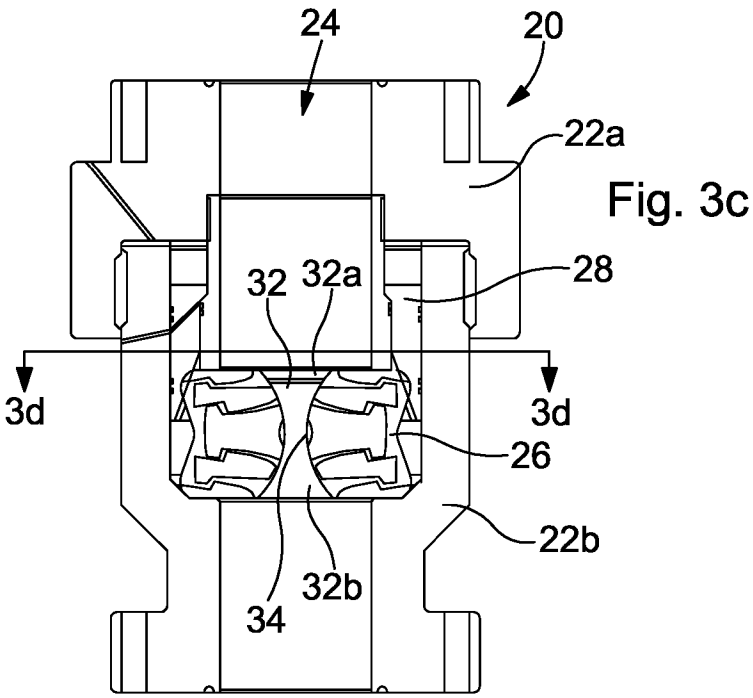
Figure 3D:
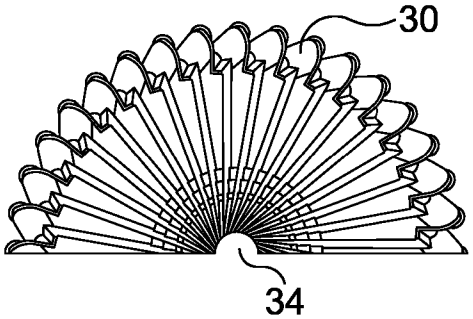

Reference is first made to FIGS. 1(*a*), 1(*b*) and 1(*c*) of the drawings which depict a prior art annular BOP packer (10) which utilises two-dimensional iris geometry technology. FIG. 1(*a*) shows a plurality of flat plates (12) arranged to form the annular packer and FIG. 1(*b*) shows a sectional view through the annular packer with the parallel bore (14). FIG. 1(*c*) depicts a packer in the closed position where the bore has been closed but it will be seen that the bore has walls (16) which are still parallel with the walls (18) of the original bore.

Figure 2A:
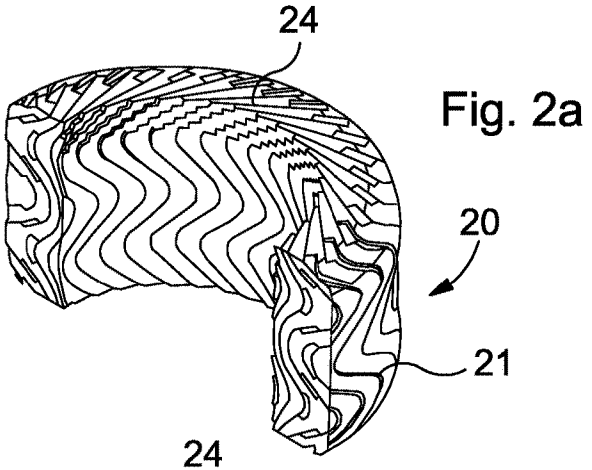
FIGS. 2(*a*), (*b*) and (*c*) depict an annular packer in accordance with an embodiment of the present invention.
Figure 2B:
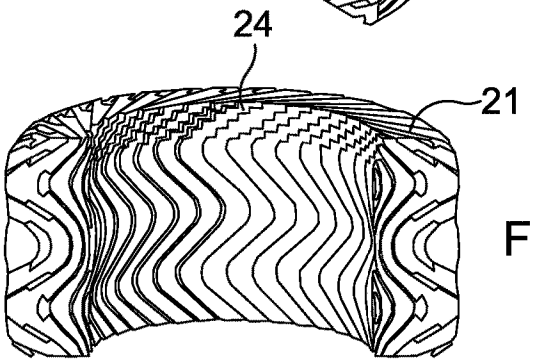
Figure 2C:
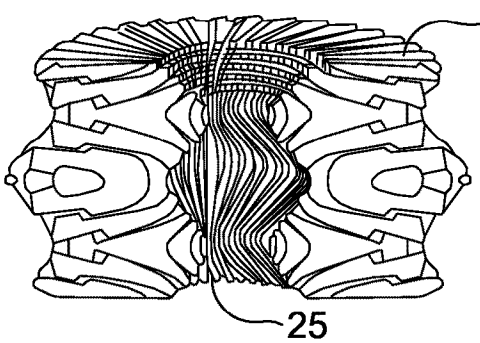

Reference is now made to FIGS. 2(*a*), 2(*b*) and 2(*c*) of the drawings which depict the first embodiment of an annular packer (20) in accordance with the present invention. It will be seen that the annular packer consists of a plurality of thirty-six (36) circumferential curved blades (21) (only 18 of which are shown in the interests of clarity) and these blades are dimensioned and proportioned to create the annular packer (20) as shown in FIGS. 2(*a*) and 2(*b*). Although the blades (21) are curved it will be seen that in the open position the bore (24) of the packer remains parallel and/or longitudinally constant in diameter, as can be best seen in FIG. 2(*b*).

When the packer is actuated from the open position shown in FIG. 2(*b*) to a closed position shown in FIG. 2(*c*) it will be seen that because of the shape of the individual packer elements or blades (21), when in the closed position the packer bore (24) although centred on the original packer centre line has interior side walls (25) which are curved and are not parallel to the original bore walls and this arrangement will be later described in detail.

Reference is now made to FIGS. 3(*a*) and 3(*b*) of the drawings. FIG. 3(*a*) depicts an annular blow out preventer (BOP) generally indicated by reference (20) which consists of a housing (22) formed primarily of upper and lower housing portions (22*a*) and (22*b*) which define an interior annulus bore (24). Disposed within the housing (22) and around the annulus bore (24) is an annular packer generally indicated by reference (26) and in FIG. 3(*a*) the annular packer (26) is shown in the open position so that the bore (24) extends all the way through the BOP (20). A cylindrical piston (28) is disposed within the annular BOP for engaging and actuating a packer (26) as will be later described. FIG. 3(*b*) depicts a top cross-sectional view of the packer (26) when disposed in the annular BOP of FIG. 3(*a*) showing the packer in the open position. It will be seen that the packer consists of a plurality of identical metal elements or blades (30) which fit together to provide the annular packer structure. The packer (26) has 36 annular elements each arranged 10 degrees apart around the circumference of the packer; the shape of each of the elements will be later described in detail.

Reference is now made to FIG. 3(*c*) of the drawing which is similar to FIG. 3(*a*) except in this position the piston (28) has been actuated to be moved downwardly and engage the packer (26) causing the annular packer to be displaced inwardly to restrict the bore (24) to a narrower hourglass shaped bore (32) within an upper funnel portion (32*a*) a lower inverted funnel portion (32*b*) and a central narrower waist or pinched portion (34).

Radial inward displacement of each of the annular elements or blades (30) to create the hourglass shape shown in FIG. 3(*c*) is best depicted in FIG. 3(*d*).

Figure 4:
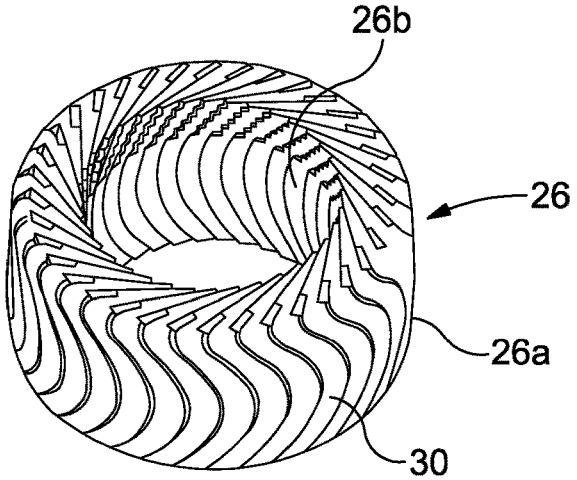
FIG. 4 is a perspective view of an annular packer according to an embodiment of the invention, in the open position.

Reference is now made to FIG. 4 of the drawings which is a perspective illustration of the packer shown in FIGS. 3(*a*) and 3(*b*) when in the open position. It will be seen that the packer consists of 36 blades circumferentially arranged at 10 degree intervals and each blade is not flat but is curved relative to a longitudinal plane parallel to the axis of bore (24). The axial section of each element (30) does not follow a linear path parallel to the axis of bore (24) but the swept section of each element (30) follows a curved path resulting in elements which are curved and not parallel with the axis of the assembly. In the arrangement shown in FIG. 4 it will be seen that these curved elements (30) nevertheless fit together to provide the annular shape shown in which the exterior elements of the blade define an external surface (26*a*) and an internal surface (26*b*) which are parallel with the bore (24).

Figure 5:
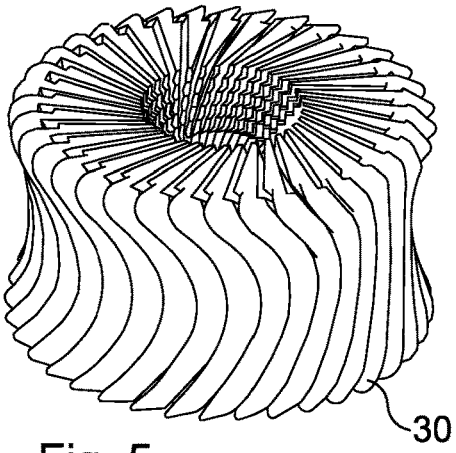
FIG. 5 is a view of the annular packer of FIG. 4 in the closed position.
Figure 6:
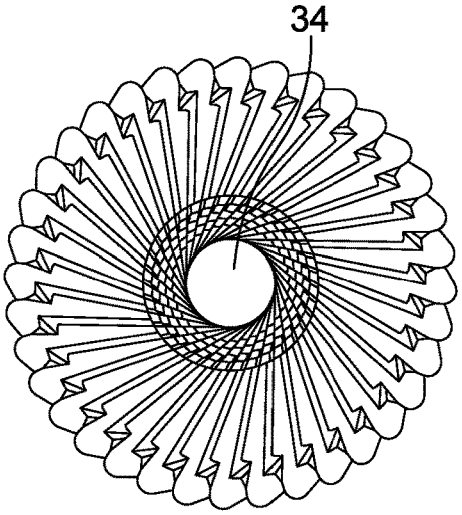
FIG. 6 is a plan view of the annular packer shown in FIG. 5 and depicting the circumferential arrangement of the blades when in the closed position.

When the piston (28) is actuated the annular packer is deformed by each of the individual blades moving simultaneously to the closed arrangement shown in FIG. 5 and best illustrated by the plan view shown in FIG. 6 where it will be seen that each of the 36 elements has been moved inwardly so that the formerly circular smooth external surface now forms effectively a toothed or serrated arrangement because of the internal shape of the piston as will later be described. This causes the bore (24) of the unactuated packer to be reduced to create the waist or neck hourglass bore portion (34) as best seen in FIG. 6.

Figure 7A:
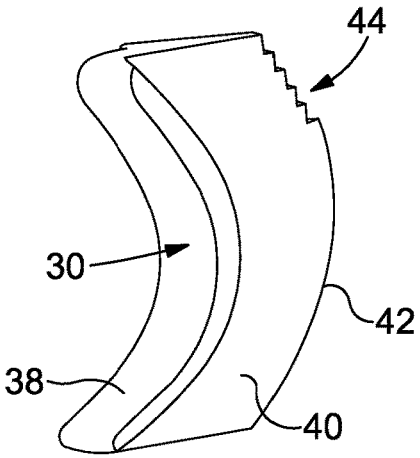
FIGS. 7(*a*) and 7(*b*) are rear and front views respectively of one of the blades shown in the packer of FIGS. 4, 5 and 6.
Figure 7B:
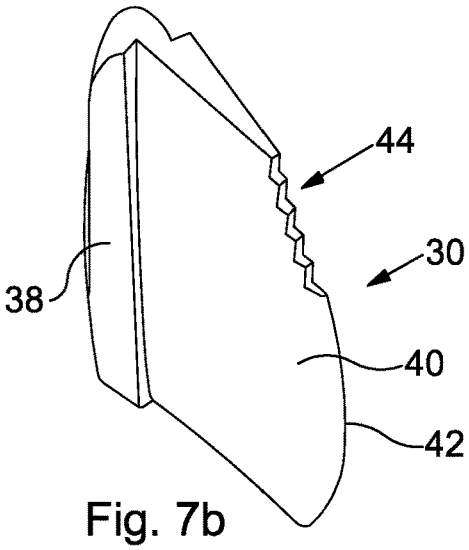
Figure 8A:
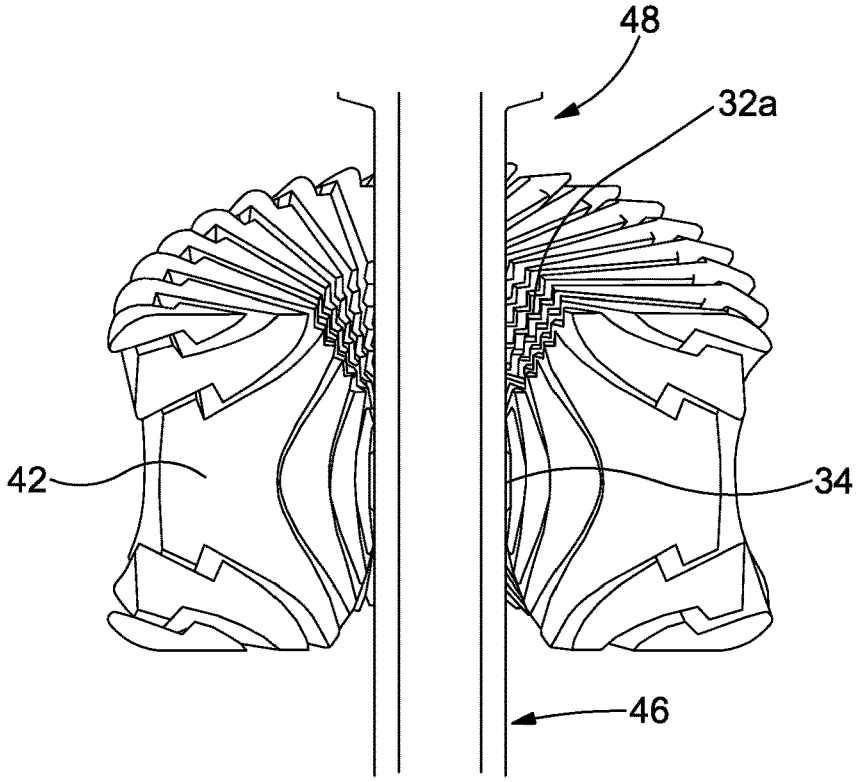
FIGS. 8(*a*) and 8(*b*) are cross-sectional views through the packer shown in FIGS. 4, 5 and 6 with a pipe located therein.
Figure 8B:
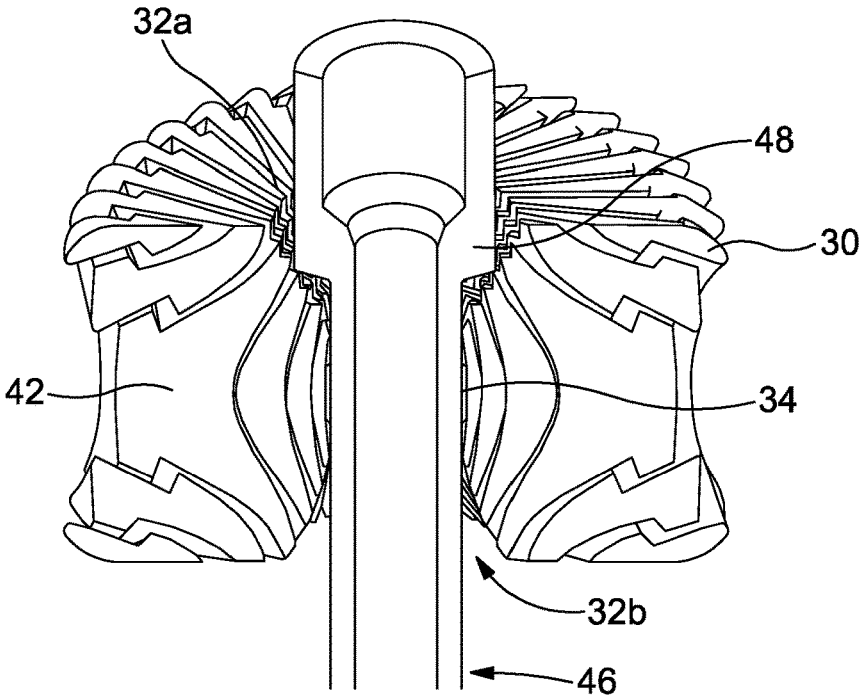

Each blade element is illustrated in FIGS. 7(*a*) and 7(*b*) which depict the exterior and interior views of the blade respectively. In FIG. 7(*a*) it will be seen that the blade consists of an exterior surface portion (38) which leads into a blade portion (40) having a curved leading edge (42) and a stepped serrated portion (44). When the packer is actuated it is the shape of these blades which when moved inwardly define the geometry of the annulus in the closed position. This is best illustrated with reference to FIGS. 8(*a*) and 8(*b*) which depict a packer energised to the closed position to define the hourglass shape (32). It will be seen that the packer seals around a pipe generally indicated by reference (46) which can move downwardly within the annular packer such that the pipe shoulders (48) are retained in the upper funnel portion (32*a*) provided by the stepped portions (44) of each of the blades (30). Thus it will be seen that in the closed position the upper funnel (32*a*) combined with the narrowest portion (34) provides a complete circular keystone arrangement or a hang off zone for suspending tools in the wells such as the petrol pipe (36) shown.

Figure 10A:
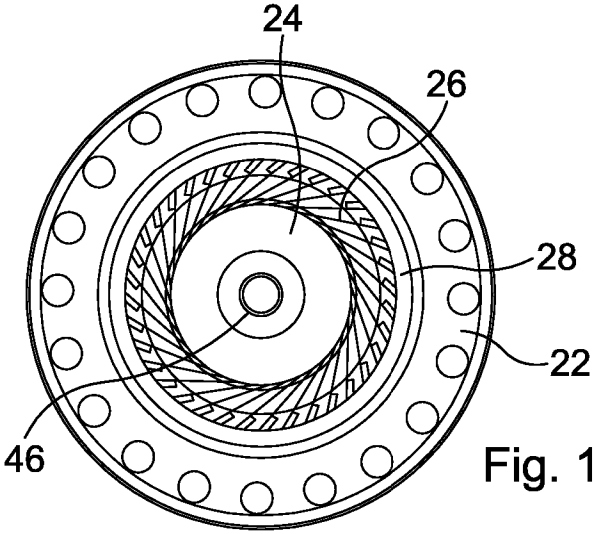
FIG. 10(*a*) is a cross-sectional view taken through an annular BOP in accordance with the invention with the annular packer shown in the open position and with a drill string shown passing through the annular BOP.
Figure 10B:
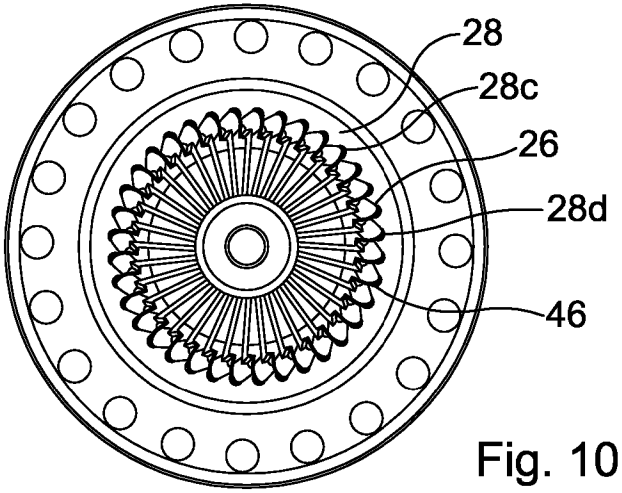
Figure 9A:
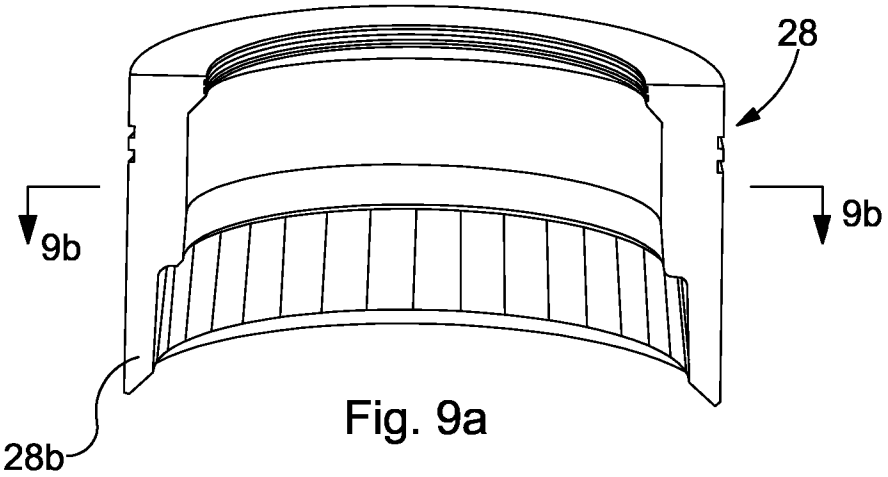
FIG. 9 is a longitudinal sectional view of a piston for use with the annular BOP in accordance with the present invention.
Figure 9B:
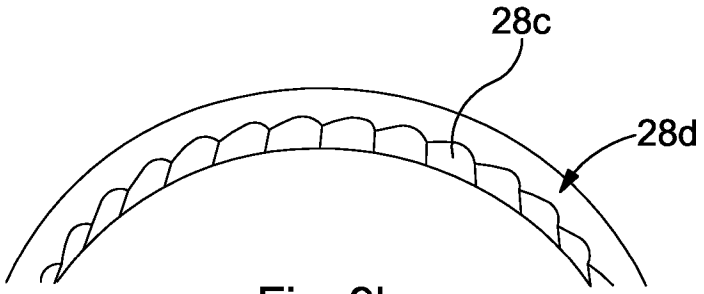

Reference is now made to FIG. 9(*a*) of the drawings which shows a sectional view through the piston (28) shown in FIGS. 3(*a*) and 3(*c*). It will be seen that the piston is circular and has at its lower portion a tapered wall portion (28*b*) which defines an internal surface (28*c*) with 36 shaped recesses (28*d*) equidistantly spaced around the circumference of the piston, as best illustrated in FIG. 9(*b*). FIG. 10(*a*) depicts a sectional view through an annular BOP just at the top of the annular packer and depicts the piston (28) circumferentially disposed around the opened annular packer (26) to define the interior bore (24) which is shown with a drill pipe (46) passing therethrough. FIG. 10(*b*) illustrates the arrangement after the piston (28) has been actuated to close the packer to the position shown in FIG. 3(*c*). In this case it will be seen that the piston has traveled to engage the packer element (30) and displaced the elements as shown such that each element (30) has been moved by the tapered internal surface (28*c*) and engages in one of the recesses (28*d*). This has caused the blades (30) to move in unison to close the packer around the drill pipe as shown in FIG. 10(*b*).

The annular packer (26) is covered or embedded in an elastomer which covers the elements (30) and any gaps between elements. When the piston (28) is actuated and forces the packer to the closed position shown in FIG. 10(*b*) it does so against elastomeric resistance so that in the closed position the annular packer is under tension. Upon release of the piston the resilience of the elastomer causes the packer to return to its original position shown in FIG. 10(*b*). When the packer (26) is compressed by the piston (28) the elements (30) are defecting and bending. Relaxation of the metallic elements from their tensioned/bending state to a relaxed state facilitates a much quicker opening of the packer similar to that of a spring. This relaxation rapidly reduces the waiting time for re-opening compared to conventional annular packers.

Figure 11:
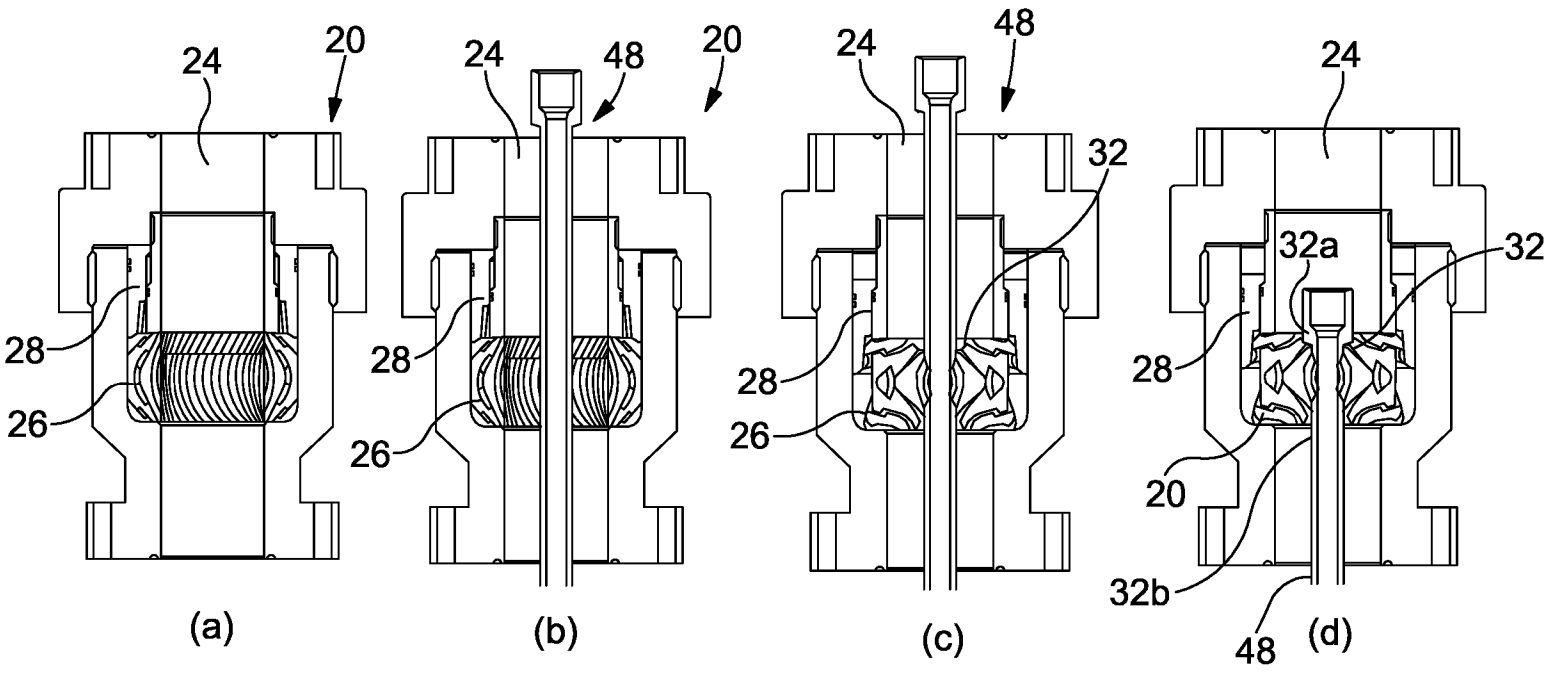
FIGS. 11(*a*), (*b*), (*c*) and (*d*) are longitudinal section views through a BOP similar to that shown in FIG. 3 with the annular packer shown in the open position in FIG. 11(*a*) with the drill pipe passing through the annular packer still in the open position of FIG. 11(*b*) with the annular packer closed around the pipe shown in FIG. 11(*c*) and with the pipe stripped through and moved down to be hung on the packer in FIG. 11(*d*)

Reference is now made to FIGS. 11(*a*), (*b*), (*c*) and (*d*) of the drawings. FIG. 11(*a*) is similar to FIG. 3(*a*) and depicts a sectional view through an annular BOP with the packer in the open position and FIG. 11(*b*) shows a drill pipe inserted through the annular BOP. FIG. 11(*c*) depicts a view similar to FIG. 3(*c*) but with the annular packer (26) closed around the pipe (48) and FIG. 11(*d*) is similar to that shown in FIG. 8(*b*) with the pipe shown in the annular packer. It will be seen that the waist or pinch point of the packer shown in FIG. 3(*c*) and FIG. 11 is mid-way between the top and bottom of the packer (26) so that the top funnel portion (32*a*) and the bottom funnel portion (32*b*) are symmetrical as the waist or pinch portion (32).

Figure 12:
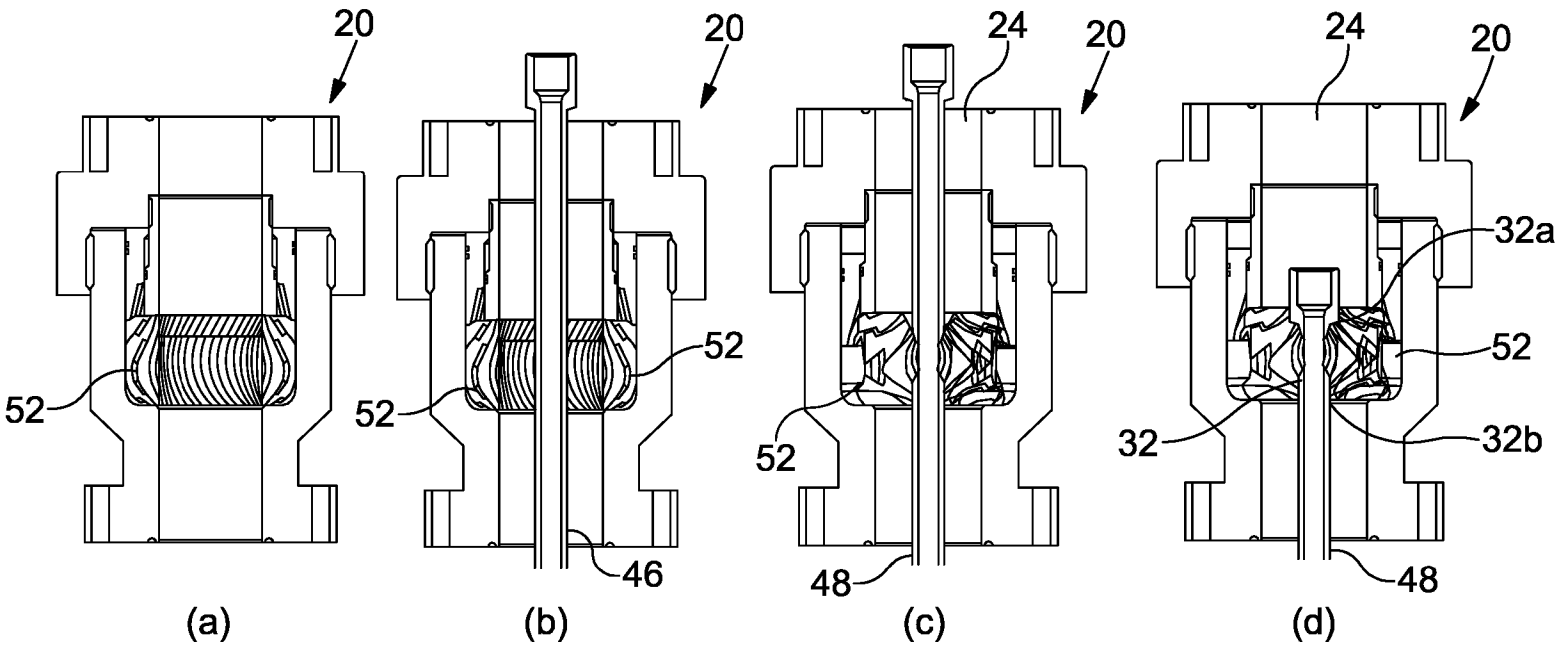
FIGS. 12(*a*), (*b*), (*c*) and (*d*) are similar to those shown in FIG. 11 but with the packer blades arranged to provide asymmetrical contact such that the minimum cross-section is in the lower half of the packer assembly.
Figure 13:
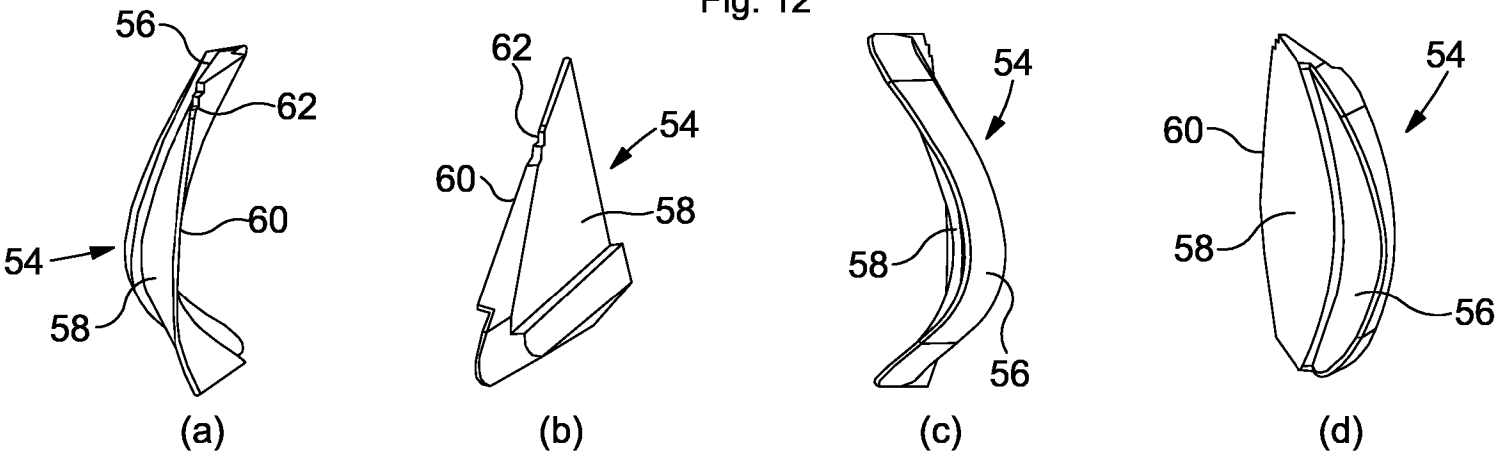
FIGS. 13(*a*), (*b*), (*c*) and (*d*) are various views of the packer elements used in the packer of FIGS. 12(*a*) to 12(*d*)

Various modifications may be made to the embodiments hereinbefore described without departing from the scope of the invention. For example the elements can be varied in shape such that when fitted in the annular packer and actuated to a closed position they provide an asymmetrical contact with the waist or contact point shifted down so that the top funnel portion (32*b*) is a longer funnel section than the bottom funnel portion (32*b*). This is best illustrated in the arrangement shown in FIGS. 12(*a*), 12(*b*), 12(*c*) and 12(*d*) which in all other aspects are similar to those shown in FIGS. 11(*a*), (*b*), (*c*) and (*d*). It will be seen that the packer in this case generally indicated by reference (52) is actuated to close around the pipe (46) such that the pinch point (32) is moved towards the bottom of the packer such that the upper funnel portion (32*a*) is longer than the lower funnel portion (32*b*). It will be seen that the blades of packer (52) generally indicated by reference (54) have a different shaped exterior curved portion (56), a different shaped curved blade portion (58) and a leading edge portion (60) and a serrated tooth portion (62) which when energised together result in the pinch point or waist portion (32) being closest to the bottom of the packer (52) as best seen in FIG. 11(*d*). This arrangement is termed to provide asymmetrical contact.

Figure 14:
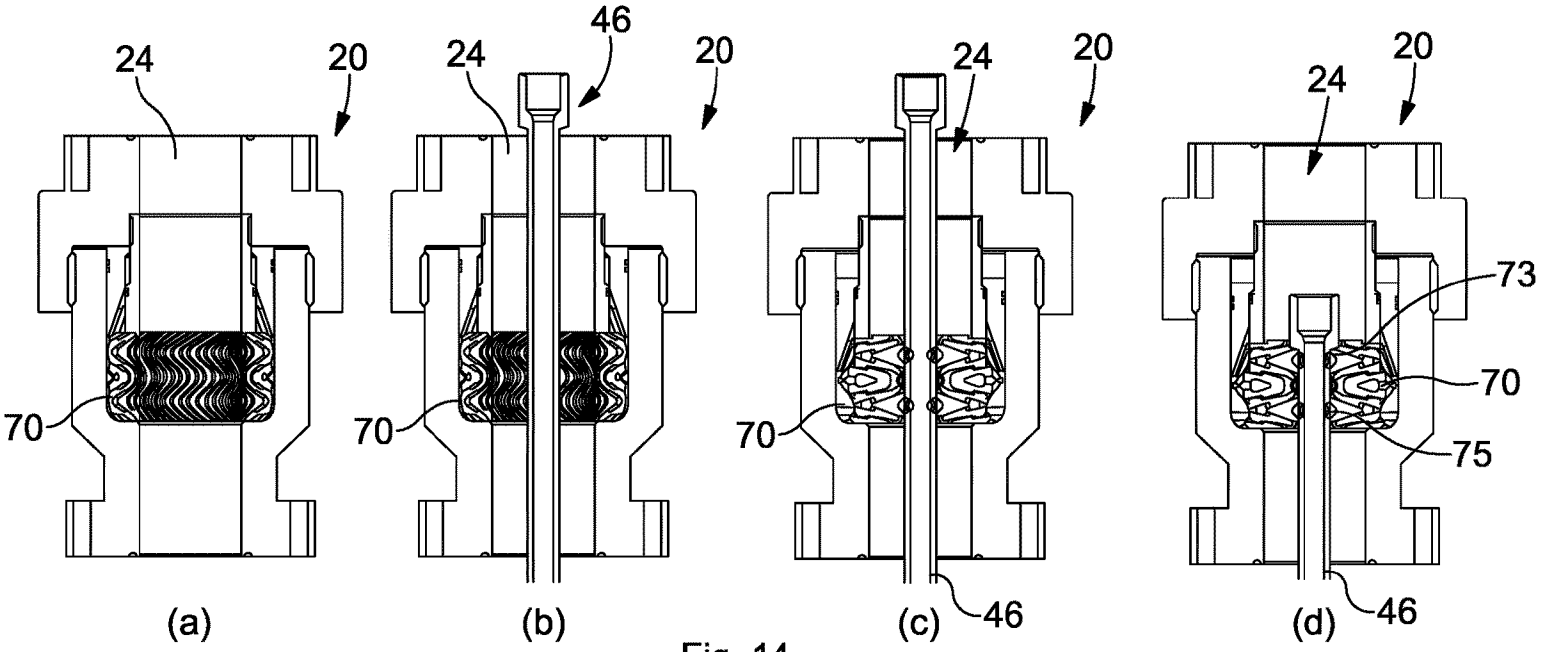
FIGS. 14(*a*), (*b*), (*c*) and (*d*) are similar to FIGS. 11(*a*) to 11(*d*) and 12(*a*) to 12(*d*) but with a different annular packer which has packer elements which provide two contact points.
Figure 15:
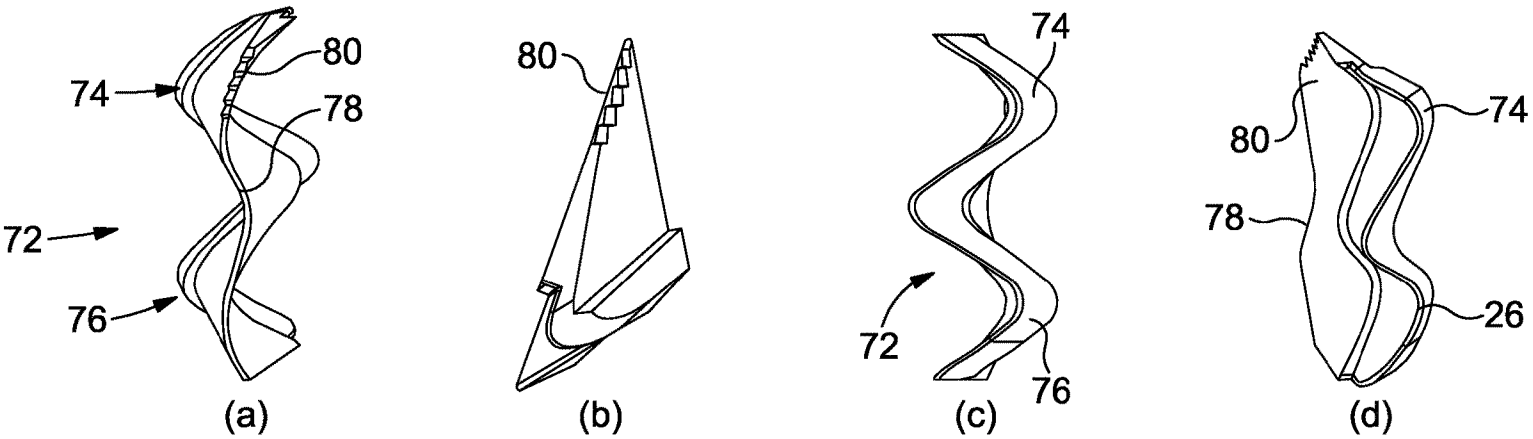
FIGS. 15(*a*), (*b*), (*c*) and (*d*) depict various views of the packer elements used in FIGS. 14(*a*) to 14(*d*) for providing a two-point contact in the closed position.

Reference is also made to a further embodiment shown in the FIGS. 14(*a*), (*b*), (*c*) and (*d*). In this case the annular BOP housing is the same but in this case the annular packer is different and has a similar arrangement and shape to that shown in FIGS. 2(*a*) to 2(*c*). In this case the annular packer generally indicated by reference (70) consists of 36 double-curved elements or blades (72) with curved portions (74) and (76) as best seen in FIGS. 15(*a*) to (*c*). The elements have leading edge portions (78) and serrated or toothed portions (80). When the packer (70) is actuated the blades (72) are radially displaced such that the upper and lower curved portions of each blade provide upper and lower waist or pinch points which engage the pipe (46) at upper and lower contact points (73) and (75) which are axially displaced along the BOP central axis as best seen in FIG. 14(*d*). With this arrangement the tool loading is distributed through the packer because of the two contact points and there is less wear on the contact position particularly in upper funnel area (32*a*) because of the distribution of load. In addition the location of the pipe tool at two separate contact points helps to centre and stabilise the tool within the annular BOP.

Various other modifications made to the embodiments hereinbefore described without departing from the scope of the invention. Although a single and double point contact annular packers are shown it is possible to have packers with blades shaped to provide three, four, or more contact points. In addition for each of the embodiments disclosed the packer has 36 elements or plates circumferentially disposed. A different number of plates may be used for example (30) or (24) with the requirements being that the number of plates used should still provide a suitable funnel section for providing a natural lead for the bore and a suitable hang off zone for loads suspended in the annular BOP.

It will be understood that all of the annular packers in the embodiments described are embedded in an elastomer and the elastomeric force restores them to their original positions in the same way as the packer of FIG. 10(*b*), when the piston force is removed. The choice of elastomer will depend on the downhole application but the elastomer will be selected to provide suitable properties and resilience and protection for the elements against well fluids.

The embodiments hereinbefore described provide the advantages of fuller contact between the piston and the packer over the full scope of the piston thus preventing and minimising point loads and jamming and the variable bore or hourglass shape provides improved opportunities for pipe stripping and suspending strings over a parallel annular bore arrangement. The provision of the hourglass shape provides a funneling effect which blurs the edge of the applied forces and thus minimises the generation of shear loads in the work piece facilitating improved stripping of pipe, and the upward facing funnel in each of the embodiments provides a natural lead-in from which strings can be suspended in the well.

The invention claimed is:

1. A method for sealing a packer comprising:

providing an annular packer in a housing of an annular blow out preventer (BOP), the BOP housing defining a through bore, said annular packer having a plurality of circumferentially spaced movable elements, each of said elements being substantially identical and moveable radially between a first position where the diameter of the through bore is a maximum and a second position where the diameter is a minimum, each element being curved relative to a plane parallel to a longitudinal axis of the annular BOP and each element being dimensioned and proportioned to fit together with adjacent elements, each element having a curved leading edge that defines at least one waist or pinch point to engage a pipe in the through bore, wherein, in the first position, the through bore defined by the packer remains longitudinally constant in diameter; and actuating a piston disposed in said housing to engage and move said elements from said first position to said second position, whereby the curved leading edges of said elements define a smaller bore with a narrower cross-section than in the first position.

2. The method according to claim 1, wherein in the second position, the at least one waist or pinch point of each element is provided between an upper funnel portion and a lower inverted funnel portion of the annular packer.

3. An annular packer for an annular blow out preventer (BOP) which has a BOP housing defining a through bore, said annular packer being disposed in said housing, said annular packer having a plurality of circumferentially spaced movable elements, each of said elements being substantially identical and moveable radially between a first position where the diameter of the through bore is a maximum and a second position where the diameter is a minimum, a piston disposed in said housing and actuatable for moving said elements from said first position to said second position, each element being curved relative to a plane parallel to a longitudinal axis of the annular BOP and each element being dimensioned and proportioned to fit together with adjacent elements, each element having a curved leading edge that defines at least one waist or pinch point to engage a pipe in the through bore, whereby, in use, actuation of said piston engages each of said elements and moves said elements to the second position, wherein, in the second position, the curved leading edges of said elements define a smaller bore with a narrower cross-section than in the first position, wherein, in the first position, the through bore defined by the packer remains longitudinally constant in diameter.

4. The packer according to claim 3, wherein each element is formed by a single curve.

5. The packer according to claim 3, wherein each element has a plurality of curves and corresponding curved leading edges whereby, when said piston is actuated, the elements are displaced to provide a corresponding plurality of narrower cross-sections axially separated along said through bore.

6. The packer according to claim 3, wherein the elements are dimensioned and proportioned so that in said second position the smaller bore is symmetrical about the narrower cross-section.

7. The packer according to claim 3, wherein the elements are dimensioned and proportioned so that in said second position the smaller bore is asymmetrical about the narrower cross-section.

8. The packer according to claim 3, wherein the packer has thirty-six identical elements.

9. The packer according to claim 3, wherein the packer has a number of identical elements sufficient to form a tapered bore to provide stripping of pipe and for suspending tools.

10. The packer according to claim 3, wherein said elements are coated with a resilient elastomer such that when pressure on said piston is released when said elements are in second position, the resilience of said elastomer moves said elements back to the first position.

11. The packer according to claim 3, wherein each of the elements is metal.

12. The packer according to claim 3, wherein a portion of the leading edge of each of said element is stepped so that in said second position an upper funnel portion is defined for facilitating pipe stripping and tool string suspension.

13. The packer according to claim 3, wherein the packer consists of the plurality of circumferentially spaced movable elements.

14. The packer according to claim 3, wherein in the second position, the at least one waist or pinch point of each element is provided between an upper funnel portion and a lower inverted funnel portion of the annular packer.

15. An annular blow out preventer (BOP) having the BOP housing defining the through bore and the annular packer according to claim 3.

* * * * *